US006660156B2

(12) United States Patent
Lorincz

(10) Patent No.: US 6,660,156 B2
(45) Date of Patent: Dec. 9, 2003

(54) PIPE ELECTROPOLISHING APPARATUS USING AN ELECTROLYTE HEATER AND COOLER

(75) Inventor: Thomas A. Lorincz, Hollister, CA (US)

(73) Assignee: Therma Corporation, Inc., San Jose, CA (US)

( * ) Notice: Subject to any disclaimer, the term of this patent is extended or adjusted under 35 U.S.C. 154(b) by 0 days.

(21) Appl. No.: 10/123,567

(22) Filed: Apr. 15, 2002

(65) Prior Publication Data

US 2002/0108867 A1 Aug. 15, 2002

Related U.S. Application Data

(62) Division of application No. 09/496,478, filed on Feb. 2, 2000, now Pat. No. 6,402,908.

(51) Int. Cl.[7] ..... B23H 11/00; B23H 5/00

(52) U.S. Cl. ..... 205/641; 205/640; 205/670; 205/673; 205/335

(58) Field of Search ..... 205/335, 641, 205/673, 670, 640

(56) References Cited

U.S. PATENT DOCUMENTS

| | | | | |
|---|---|---|---|---|
| 2,764,540 A | | 9/1956 | Farin et al. | 204/140.5 |
| 3,055,812 A | | 9/1962 | Andersson | 204/140.5 |
| 3,202,598 A | | 8/1965 | Covington et al. | 204/224 |
| 3,329,596 A | | 7/1967 | Abt et al. | 204/143 |
| 4,369,101 A | | 1/1983 | Wolff et al. | 204/224 R |
| 4,645,581 A | | 2/1987 | Voggenthaler et al. | 204/275 |
| 4,705,611 A | | 11/1987 | Grimes et al. | 204/129.1 |
| 4,772,367 A | | 9/1988 | Menzel et al. | 204/129.5 |
| 4,826,582 A | | 5/1989 | Lavalerie et al. | 204/196 |
| 5,096,550 A | * | 3/1992 | Mayer et al. | 205/642 |
| 5,112,453 A | * | 5/1992 | Behr et al. | 205/641 |
| 5,135,625 A | | 8/1992 | Lewy | 204/129.6 |
| 5,441,516 A | | 8/1995 | Wang et al. | 606/198 |
| 5,507,923 A | | 4/1996 | Stouse et al. | 205/679 |

* cited by examiner

*Primary Examiner*—Roy King
*Assistant Examiner*—Wesley A. Nicolas
(74) *Attorney, Agent, or Firm*—Henneman & Saunders; Larry E. Henneman, Jr.

(57) ABSTRACT

A temperature handling subsystem (12) for a pipe electrochemical polishing system (10) has a chiller (46) and associated heat exchanger (44) for cooling the acid electrolyte (24) circulating through a pipe (28) while a cathode (14) is drawn therethrough for the purpose of electropolishing the interior of the pipe (24). A temperature control method (48) has a temperature low enough decision operation (58) wherein a temperature indicating control (38) is used to determine if the chiller (46) should be activated. The electrolyte (24) is pumped by an electrolyte pump from an electrolyte reservoir (22) containing a temperature indicating controller (38) for determining the temperature of the electrolyte (24) and further containing an electric heater (36) for heating the electrolyte (24), as necessary.

16 Claims, 2 Drawing Sheets

PIPE ELECTROPOLISHING APPARATUS USING AN ELECTROLYTE HEATER AND COOLER

RELATED APPLICATIONS

The present application is a divisional of co-pending U.S. patent application Ser. No. 09/496,478, entitled "In Pipe Electropolishing Apparatus Using an Electrolyte Heater and Cooler," filed Feb. 2, 2000, and now U.S. Pat. No. 6,402,908, which is incorporated herein by reference in its entirety.

TECHNICAL FIELD

The present invention relates to the field of electrochemical processing, and more particularly to an improved fluid chemical system for the chemical used in the process. The predominant current usage of the present inventive improved fluid system is in the handling of chemical electrolyte used for in place electropolishing, wherein it is desirable to reduce the cumulative temperatures imparted to the fluid electrolyte due to the substantial heat created in the process.

BACKGROUND ART

It is known in the art to deposit and/or remove materials by passing an electric current through a fluid electrolyte which is in contact with a conductive electrode. Materials are exchanged between the electrolyte and the electrode depending upon the direction of current flow and the ionization of materials to be deposited on or removed from the electrode. Electroplating is a well known application of this general method. Electropolishing is also well known in the art. In the electropolishing process, irregularities and deposits on a surface are removed by causing such to be drawn into the electrolyte solution.

In many electrochemical processes, the temperature of the electrolyte can be readily controlled. Since a large quantity of electrolyte is used to immerse the electrode, the temperature of the electrolyte is generally stable, even though heat is introduced in the process. However, recent developments in the art have resulted in "in place" electrochemical processing. An example is the in place electrochemical polishing of a pipe. In such an example, a cathode is drawn through the pipe while an electrolyte solution is simultaneously piped through the pipe. The pipe acts as an anode and is electrochemically polished in the process. Since the electrolyte solution must be continuously pumped through the pipe during the process, it is most practical to recirculate the solution. However, since a significant amount of heat is generated in the process, the electrolyte tends to become overly heated as the process continues. This might not, upon first examination, seem to be a significant problem. Indeed, it is desirable that the electrolyte be heated higher than the ambient temperature. Nevertheless, the inventor has found that, as a practical matter, the electrolyte does become dramatically over heated during many such operations.

Therefore, it would be desirable to have some method and or means for avoiding or, at least, minimizing the undesirable effects caused by the heating of electrolyte during an electrochemical process. While increasing the quantity of electrolyte used is one possible solution, it would be desirable to have an alternative method and/or means which does not have the disadvantage of the additional bulk and additional expense associated with the use of an additional quantity of electrolyte.

DISCLOSURE OF INVENTION

Accordingly, it is an object of the present invention to provide an apparatus and method for reducing the electrolyte temperature during an electrochemical process.

It is still another object of the present invention to provide an apparatus and method for improving an electrochemical process.

It is yet another object of the present invention to provide a method and apparatus for keeping the parameters of an electrochemical process within acceptable tolerances.

It is still another object of the present invention to provide a method and apparatus for reducing the quantity of electrolyte needed during an electrochemical process.

It is yet another object of the present invention to provide a method and apparatus for reducing the time required to accomplish an electropolishing process.

Briefly, a known embodiment of the present invention is an improved in place electropolishing apparatus for polishing a pipe. In an electrolyte handling subsystem, a cooler is provided for cooling a fluid electrolyte as the electrolyte is recirculated through the pipe. Optionally, a temperature sensor controls the operation of the cooler.

An advantage of the present invention is that the temperature of the fluid electrolyte is reduced.

A further advantage of the present invention is that temperature dependant electrical parameters, such as resistance, can be readily kept within acceptable tolerances.

Yet another advantage of the present invention is that a lesser quantity of electrolyte is required, since the fluid electrolyte can be cooled and recirculated.

These and other objects and advantages of the present invention will become clear to those skilled in the art in view of the description of modes of carrying out the invention, and the industrial applicability thereof, as described herein and as illustrated in the several figures of the drawing. The objects and advantages listed are not an exhaustive list of all possible objects or advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed objects and/or advantages are not essential elements of the present invention, and should not be construed as limitations.

DETAILED DESCRIPTION OF THE INVENTION

Figure 1:
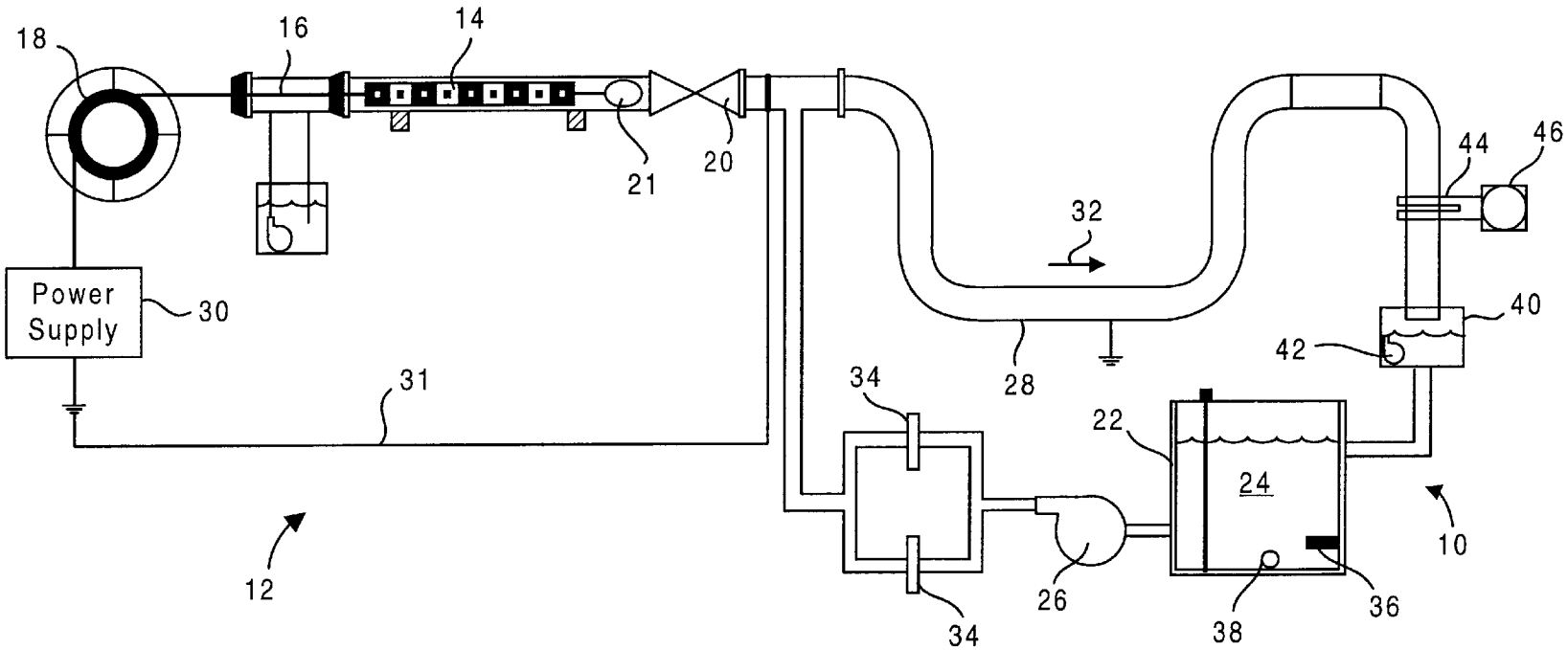
FIG. 1 is block diagrammatic view of an example of an in place pipe electropolishing system having an electrolyte temperature control system according to the present invention.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

Unless otherwise stated herein, component parts of the invention will be familiar to one skilled in the art, and may be purchased or readily manufactured accordingly. Also, unless otherwise stated herein, substitutions can be made for the components described, and each of the individual components, except as specifically claimed, is not an essential element of the invention.

A known mode for carrying out the invention is an improved electrolyte handling subsystem 10 which is, in this example, as part of an in place pipe electrochemical polishing system 12. The in place pipe electrochemical polishing system 12 is depicted in a block schematic diagrammatic view in FIG. 1. As one skilled in the art will recognize, some of the relevant component parts of the in place pipe electrochemical polishing system are a cathode 14, a cathode puller cable 16, a cable puller 18, a valve 20, a dam 21, an electrolyte reservoir 22 for containing a supply of an electrolyte 24, and an electrolyte pump 26, all of which are provided for the purpose of polishing the interior of a pipe 28. In the electrochemical polishing process, the cathode 14 is drawn toward the cable puller 18 by the cathode puller cable 16, while current is applied through the cathode 14 from a power supply 30. The current flows through the electrolyte 24 in the pipe 28, which shares a common ground with the power supply 30 such that the pipe 28 acts as an anode and the interior thereof is polished, according to the known principles of electropolishing. A ground wire 31 provides a good ground from the power supply 30 to the pipe 28. During the process, the electrolyte 24 is pumped to flow through the pipe 28 in a direction 32 opposite that in which the cathode 14 is being drawn. The valve 20 prevents the electrolyte 24 from escaping the pipe 28 while allowing the cathode puller cable 16 to be pulled therethrough.

In the example of the inventive electrolyte handling subsystem 12, two filters 34 are placed in the path of the electrolyte to insure that particulate matter removed from the inside of the pipe 28 is removed from the electrolyte 24 solution as it is recirculated through the electrolyte handling subsystem 12 by the electrolyte pump 26. A lesser or greater quantity of the filters 34 could be used, as necessary or desirable according to the application.

In the example of the invention shown in FIG. 1, an electric heater 36 and temperature indicating control 38 are provided in the path of the electrolyte 24. In this example, the electric heater 36 and the temperature indicating control 38 are located in the electrolyte reservoir 22. Also, in the present example of the invention, a collector sump 40 catches the electrolyte 24 as it flows out of the pipe 28, and a collector sump pump 42 pumps the electrolyte 24 from the collector sump 40 to the electrolyte reservoir 22. A heat exchanger 44 is provided in the path of the electrolyte 24 with a chiller 46 operatively connected thereto. The chiller 46 is a conventional refrigeration unit and pump, and the heat exchanger 44 is adapted to transfer heat from the electrolyte 24 in the pipe 28 to the chiller 46. The application and use of the chiller 46 and the heat exchanger 44 will be discussed in more detail, hereinafter.

Figure 2:
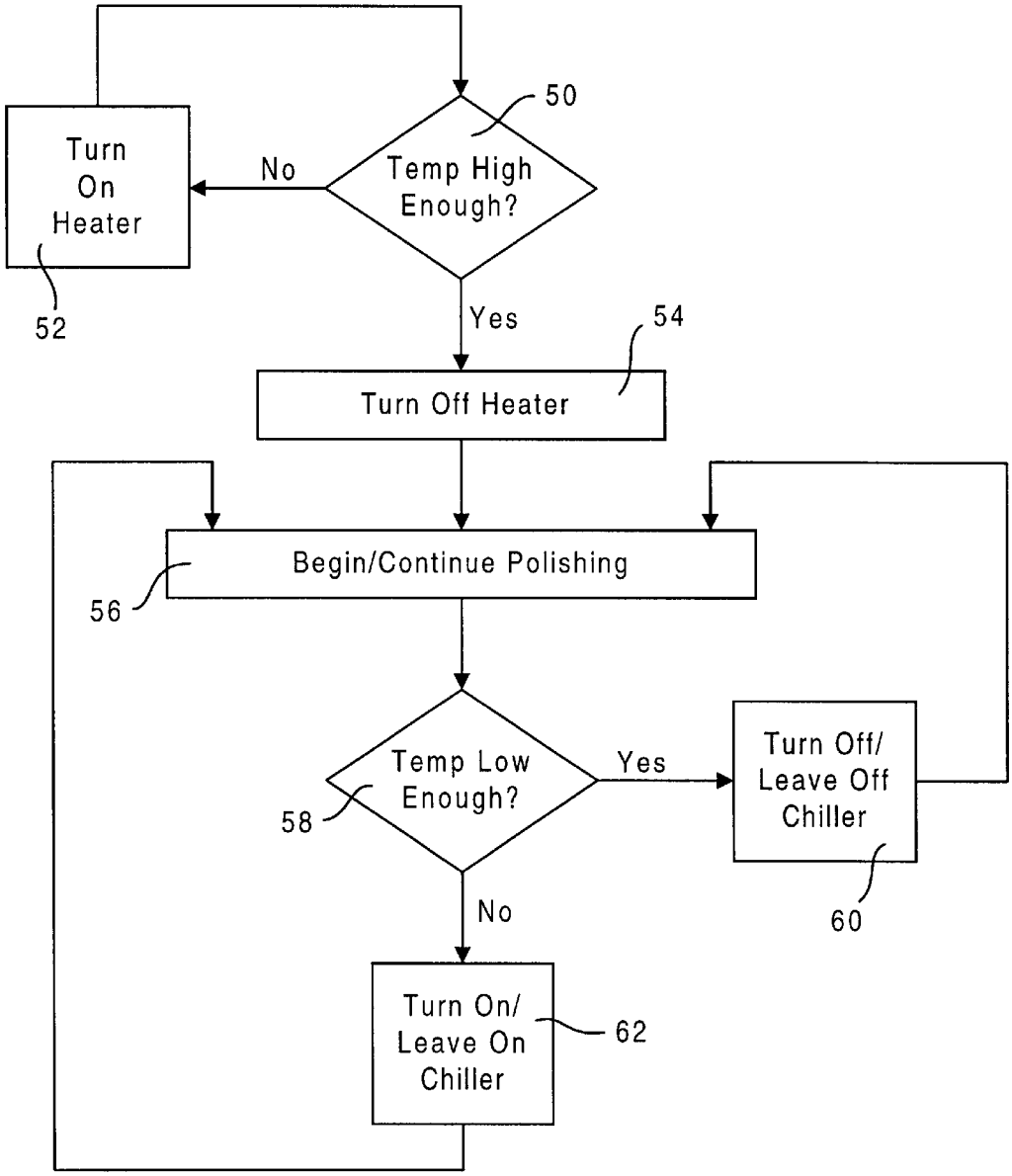
FIG. 2 is a flow diagram showing an example of a electrolyte temperature control method according to the present invention.

FIG. 2 is a flow diagram depicting an example of the inventive electrolyte temperature control method 48. The method 48 will be described herein with reference both to FIGS. 1 and 2. When the pipe electrochemical polishing system 10 is first activated, it is likely that the temperature of the electrolyte 24 will be out of range. One skilled in the art of electropolishing will be familiar with what amounts to an acceptable temperature range for a given application, considering the material of the pipe 28, the type and concentration of the electrolyte 24, the current to be provided by the power supply 30, the speed at which the cathode 14 is to be drawn through the pipe 28 and the like. Normally, the temperature is expected to be low when the system is first turned on. In a temperature high enough decision operation 50, the temperature indicating control 38 is used to determine if the temperature of the electrolyte 24 is sufficiently high to begin the electropolishing process. When the temperature is low, the electric heater 36 is turned on in a turn on heater operation 52 to raise the temperature of the electrolyte 24.

It should be noted that each of the operations depicted in the example of FIG. 2 is accomplished repetitively as long as the electropolishing operation continues. That is, temperatures are checked, operations are performed based upon the result of such check, and then the temperature is checked again, and so on. Accordingly, when the temperature comes within range in the temperature high enough decision operation 50 the heater 36 is turned off in a turn off heater operation 54 and then current is applied to the cathode 14 and the cathode 14 is begun to be drawn through the pipe 28 in a begin/continue polishing operation 56.

When, in a temperature low enough decision operation 58, it is determined that the temperature of the electrolyte 24 is not above range the chiller 46 is left off (if already off) or turned off (if on) in a turn off/leave off chiller operation 60. When, in the temperature low enough decision operation 58, it is determined that the temperature of the electrolyte 24 is too high, the chiller 46 is turned on (if off) or left on (if already on) and the electrolyte 24 is cooled by the heat exchanger 44 in a turn on/leave on chiller operation 62.

It should be noted that the flow diagram of FIG. 2 is not specific as to whether the operations are automatically controlled or manually initiated. In the example of the invention described, an operator initiates the operations based upon a reading of the temperature indicating controller 38, although it is anticipated by the inventor that the operations could be placed entirely under computer control or otherwise automated.

Various modifications to the inventive method are also quite possible, while remaining within the scope of the invention. For example, while no provision is made in the example of FIG. 2 for shutting down the entire procedure should the temperature become exceedingly high, one skilled in the art will recognize that it would be a simple matter to cause the temperature indicating controller 38 to shut down the electropolishing process should the temperature reach some predetermined level higher than that temperature at which the chiller 46 is initially turned on.

It should be noted, as one skilled in the art will recognize, that the electrolyte 24 is an acid and, therefore, all components which come into contact with the electrolyte 24 should be selected to be capable of withstanding the acid. Furthermore, users of the invention should take the appropriate and necessary precautions for handling the electrolyte 24.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive electrolyte handling subsystem 12 is intended to be widely used in electrochemical processing systems. While the invention could be adapted for use with many types of such systems, it is intended initially for use with in place systems, wherein the electrolyte 24 is recirculated. In such systems it has been found that the electrolyte is further heated each time that it passes through the active area wherein the cathode 14 is electrically interacting with the anode (the pipe 28, in this example).

Since the inventive electrolyte handling subsystem 12 of the present invention may be readily produced and integrated with existing electropolishing and electroplating devices, and since the advantages as described herein are provided, it is expected that it will be readily accepted in the industry. For these and other reasons, it is expected that the utility and industrial applicability of the invention will be both significant in scope and long-lasting in duration.

What is claimed is:

1. A method for controlling the temperature of an electrolyte in a pipe inner surface electropolishing process, comprising:

determining if the temperature of the electrolyte in the pipe inner surface electropolishing process is above a predetermined range;

selectively turning on a chiller apparatus when it is determined that the temperature of the electrolyte is above the predetermined range;

determining if the temperature of the electrolyte is below a predetermined range; and selectively turning on a heater when it is determined that the temperature of the electrolyte is below the predetermined range.

2. The method for controlling the temperature of an electrolyte of claim 1, and further including:

repeating the steps of claim 1 periodically.

3. The method for controlling the temperature of an electrolyte of claim 1, wherein:

the chiller includes a refrigeration unit and a heat exchanger operatively connected thereto such that heat energy is transferred from the electrolyte to the refrigeration unit through the heat exchanger.

4. A method for controlling the temperature of an electrolyte in a pipe inner surface electropolishing process, comprising:

determining if the temperature of said electrolyte in said pipe inner surface electropolishing process is below a first predetermined temperature;

determining if the temperature of said electrolyte in said pipe inner surface electropolishing process is above a second predetermined temperature;

selectively heating said electrolyte if the temperature of said electrolyte is below said first predetermined temperature; and selectively cooling said electrolyte if the temperature of said electrolyte is above said second predetermined temperature.

5. The method for controlling the temperature of an electrolyte according to claim 4, and further including repeating said steps of claim 4 periodically.

6. The method for controlling the temperature of an electrolyte according to claim 4, wherein said step of heating said electrolyte includes heating said electrolyte with a heater.

7. The method for controlling the temperature of an electrolyte according to claim 4, wherein said step of heating said electrolyte includes heating said electrolyte prior to delivering said electrolyte to said pipe.

8. The method for controlling the temperature of an electrolyte according to claim 4, wherein a heater is disposed in a reservoir of said electrolyte.

9. The method for controlling the temperature of an electrolyte according to claim 4, wherein said step of cooling said electrolyte includes circulating said electrolyte past a heat exchanger, said heat exchanger adapted for conducting heat away from said electrolyte.

10. The method for controlling the temperature of an electrolyte according to claim 9, wherein said step of circulating said electrolyte past said heat exchanger further includes removing said heat from said heat exchanger with a refrigeration unit.

11. The method for controlling the temperature of an electrolyte according to claim 4, wherein said step of cooling said electrolyte includes cooling said electrolyte as said electrolyte is circulated through a second pipe coupled to said pipe.

12. The method for controlling the temperature of an electrolyte according to claim 4 wherein said step of cooling said electrolyte includes cooling said electrolyte before returning said electrolyte to a reservoir of said electrolyte.

13. The method for controlling the temperature of an electrolyte according to claim 4, wherein said step of cooling said electrolyte comprises fixing a heat exchanger to the outside of a portion of said pipe.

14. The method for controlling the temperature of an electrolyte according to claim 4, wherein at least one of said steps for controlling the temperature of said electrolyte is accomplished manually.

15. The method for controlling the temperature of an electrolyte according to claim 4, wherein at least one of said steps for controlling the temperature of said electrolyte is automated.

16. The method for controlling the temperature of an electrolyte of claim 1, wherein the step of turning on the heater occurs prior to beginning the pipe inner surface electropolishing process.

* * * * *